United States Patent [19]

Sackmann et al.

[11] 4,079,795

[45] Mar. 21, 1978

[54] METHOD AND A DEVICE FOR DRILLING WITH SEVERAL TOOLS IN SIMULTANEOUS OPERATION

[75] Inventors: Wilfried Sackmann, Erkelenz; Georg Hurtz, Erkelenz-Holzweiler; Fritz Tibussek, Monchen-Gladbach, all of Germany

[73] Assignee: Maschinen-und Bohrgerate-Fabrik Alfred Wirth & Co., K.G., Germany

[21] Appl. No.: 652,617

[22] Filed: Jan. 26, 1976

[30] Foreign Application Priority Data

Jan. 28, 1975 Germany ..... 2503340

[51] Int. Cl.[2] ..... E21B 3/06; E21D 9/10

[52] U.S. Cl. ..... 175/24; 175/27; 173/4; 299/1

[58] Field of Search ..... 175/24, 26, 27, 45, 175/38, 39; 299/1; 173/4, 5, 7, 12

[56] References Cited

U.S. PATENT DOCUMENTS

| | | | |
|---|---|---|---|
| 3,039,543 | 6/1962 | Loocke | 175/26 |
| 3,593,807 | 7/1971 | Klima | 173/6 |
| 3,613,805 | 10/1971 | Linstad et al. | 175/27 |
| 3,743,033 | 7/1973 | Taylor | 173/4 |
| 3,778,106 | 12/1973 | Taylor et al. | 173/4 |
| 3,800,277 | 3/1974 | Patton et al. | 175/26 |
| 3,971,449 | 7/1976 | Nylund et al. | 175/27 |

*Primary Examiner*—Ernest R. Purser
*Assistant Examiner*—Richard E. Favreau
*Attorney, Agent, or Firm*—Holman & Stern

[57] ABSTRACT

A method for drilling boreholes utilizing a plurality of simultaneously operated boring tools. During a drilling operation the loading forces on the tools are measured and constantly compared with a predetermined limiting value representative of a limiting loading value and the variation of a limiting loading value with respect to time. If these limiting values are exceeded at least one working parameter of the tools is adjusted such as feed force, feed speed or track speed of the tools. Apparatus for carrying out the method is also disclosed.

54 Claims, 8 Drawing Figures

METHOD AND A DEVICE FOR DRILLING WITH SEVERAL TOOLS IN SIMULTANEOUS OPERATION

The invention relates to a method and a device for drilling bore holes with severals tools in simultaneous operation which are guided over circular paths and carry out a common forward movement in the direction of the borehole. The device is especially useful for drilling large boreholes.

Drilling methods using several implements in simultaneous operation have been employed in making boreholes of various kinds, for instance, vertical or oblique boreholes in underground workings, well construction, opencast mining of brown coal, and other branches of mining, waste wells and shaft bores, further, and in particular, in drilling horizontal or inclined tunnels, and galleries. The diameters of the boreholes may, in the case of wide boring, lie in the range from 600 mm, and possible less, to 5000 mm and over. The essential controlling variables or working parameters in such drilling methods are, on the one hand, the travelling speed of the individual tools in their circular paths (according to the number of revolutions of the rotary body mounting the tools) and the force or speed of advance, on the other, with which the tools in circular rotation are driven forward at the base of the borehole or applied to the rock face.

If the drilling is carried out in homogeneous rock all the tools are exposed to equal stress. This may be taken as the optimal case. Yet even here the track speed of the tools and the feed force or feed speed must be so chosen as not to overload the tools. Thus certain values of these quantities must not be exceeded or not exceeded for too long. This is often difficult to recognize by those in charge of the drilling work.

Special problems arise when the rocks to be drilled are inhomogeneous, or suddenly become inhomogeneous after a long homogeneous run and differ in hardness over the rotary path of the tools, have been disturbed or contain hard inclusions. It may then happen that only a few or even only a single one of the tools come to grips with such inclusions in the otherwise homogeneous and soft rocks. In this case a number of more or less strong shocks are exerted on the tools in question, without this being observed by those responsible for the drilling, so that no remedial steps can be taken.

The overloading of the tools by excessive forces and especially by shocks arising from the inhomogeneities or inclusions in the rocks affects the wear and the useful life of the tool quite decisively. This is true not only of the cutting edge of the tool, but also of the retaining chuck or bearing, notably in roller bits. A reduced useful life or even the destruction of the tools or their bearings, such as may readily occur through repeated hard shocks, involves considerable costs that arise not only from the expense of re-equipment or repairs and mounting of the tools themselves, but also from the interruption of the drilling work and the time of inaction of expensive apparatus.

It is the object of the invention to overcome the present difficulties and inconveniences and find a satisfactory way of drilling with several tools moving in closed tracks that eliminates in so far as possible excessive stresses on the tools and increases the useful life of the tools and of their holders or bearings, in order thus to make the drilling work and the use of drilling implements, especially for large boreholes such as tunnels, more economical as well. It is further within the scope of this object to attain the desired effects in a way that would reduce the burden the personnel engaged in the drilling operations and would require as few as possible, or even none at all, of on-the-spot decisions having direct bearing on the progress of the operations. Further problems associated with this general object that the invlention deals with will emerge from the particular explanation of the indicated solution.

The drilling method according to the invention is characterized in that during the drilling operation at least in the case of some of the mobile tools the forces representing the load on the same and/or the variation of such forces in time are determined and currently compared with a predetermined limiting value, and that if this limiting value is exceeded at least one working parameter (feed force or feed speed, track speed of the tools) is modified in quantity so as to remove the excess.

The resultant of all the forces acting on the tool is not to be taken alone as representative of the load on the tool and decisive for the useful life of the tool and its mounting or bearings. For example, in the case of a roller bit the force arising from its pressure against the rock and so radial to the axis of the roller is paramount, so that it is enough in many cases to determine the evaluate for adjusting or altering the working parameter of the drilling operation this force or its not inconsiderable component, or even a force that is decisively affected by the pressure of application but deviates from this in direction.

Which particular force or force component is taken for evaluation, can depend on the type of the tools, on the particular geometry or form of the element mounting the tools, e.g. a drill head, and on the possibilities open for measuring the forces in question. Consequently, no very narrow boundaries can be set for the choice of the force to be considered. This force should only be sufficiently strong and reproducible. Apart from the pressure of application or its component, more particularly a peripheral or transverse stress, or a force incorporating the rolling resistance to a rotatably mounted tool, or a force depending on it, may also be taken into consideration as representative of the tool loading. This may be advantageous in the case of certain kinds of shock stress and if the tools or their bearings are particularly sensitive to such stresses.

In addition to or instead of determining the size of the force, it may be recommended to measure the duration of its action or the variation of the force with time. It is then possible to encompass and evaluate the slope of the increase of the force, which gives a measure of the hardness of the knocks or shocks acting on the tool encountering inclusions or in an inhomogeneous rock. This is not limited to any definite direction of the force (stress), but is true fundamentally of different forces and directions of their action.

The method according to the invention affords the advantage that cannot be overestimated of being able to adjust the boring operation when drilling with several tools rotating in closed tracks in simultaneous action to any particular conditions, to take into consideration the type of rock or mountain that is drilled, to prevent overloading the tools and so to increase their useful life. If the predetermined value for the stress or its variation in time is exceeded, the working parameter or parameters can be correspondingly reset so as to keep the relevant quantities below the limiting value.

If the stress is determined in the method just explained, then should the preset limiting figure be exceeded for this stress the forward driving force or the speed of advance may advantageously be reduced so as to obtain a condition where the load on the tools stays within a range regarded as acceptable. Instead of this, or else in addition to it, if the limiting stress is exceeded the track speed of the tools may be increased, in order to ensure the admissible load condition for the tools.

If the stress is found to vary in time and it exceeds the limited value, the forward driving (feed) force or the speed of advance or the track speed of the tools is decreased, while the other quantities are kept substantially constant. Here too, however, it is possible to vary both quantities simultaneously when the limiting value is exceeded.

A simultaneous change in the feed speed and track speed in the suitable direction may also take place if the stress is found both to increase and to vary in time and to exceed the limiting values in both respects.

If the limiting value is exceeded the corresponding working parameter may advantageously be altered to a predetermined value, and more particularly to a value chosen according to the measure of excess and corresponding to a tool loading below that regarded as admissible, and then the value of this working parameter is again altered in the opposite sense until a predetermined value or a value chosen in relation to some other quantity is reached.

In many cases it is of advantage in altering the working parameter always to use the highest of the values exceeding the limiting value.

The further changing of the relevant working parameter after an initial change of the same taking into consideration the crossing of the preset boundary may be effected e.g. in a predetermined time interval. It may be advantageous to carry out the renewed change the more slowly the greater is the number of values exceeding the limiting value during a given period. The change may be carried out continuously or stepwise. More particularly at least one intermediate stage with the working parameter staying substantially constant may be maintained during the change. A definite time may be allowed for the duration of this intermediate stage. In particular a further change of the working parameter following the intermediate stage may be made when a period of $2\pi/a$ without a renewed crossing of the boundary value has been completed since it was crossed in the first place, "$2\pi$" denoting a full circular run of a tool and "$a$" the number of tools moving along a given circular track. If there are several concentric circular tracks with tools moving in these the period of $2\pi/a$ may be different for each track according to the number of tools on it. If the limiting value is exceeded on only one of the operative tracks it is possible to take into consideration the period corresponding to this track as well. In general, however, it will suffice to use only one, namely the longest, period for all the processes.

The value of the working parameter in the intermediate stage may be, for instance, the one predetermined for one particular working process. The invention further provides for the choice of the working parameter in the intermediate stage according to the measure by which the limiting value has been exceeded.

Starting from the finding that the torque needed for moving the tools in their circular track before the overstress should not be too great, the invention provides that if a predetermined value of this torque is exceeded the forward driving force of the speed of advance is reduced and/or the track speed of the tools is increased.

The relevant working parameter is advantageously changed in the indicated sense to such an extent only as to bring the torque just back below the predetermined maximal value. According to the circumstances and the rocks being drilled one or another working parameters may be preferentially altered. Thus e.g. first the track speed of the tools may be raised up to a definite maximum value and then the forward speed reduced, or vice versa first the forward speed lowered to a predetermined minimal value and then the track speed raised. Furthermore, it is also possible to vary both the working parameters at the same time, continuously or stepwise, until the torque has dropped below the minimum value.

A further subject of the invention is a device which comprises a drill head carrying a plurality of tools, a rotary drive for the drill head, as well as a forward drive for the same, and which is characterized in force measuring means associated with at least some of the tools on the drill head, a maximum-value counter following the said means, possibly with the interposition of an amplifier, as well as an operational device processing the signals of the said measuring means, whereby the forward drive and/or the rotary drive of the drill head can be controlled over servo members.

In an especially advantageous form of embodiment of the device this is capable of operating automatically.

The invention will now be described by way of example with reference to the accompanying drawings, wherein.

Figure 1:
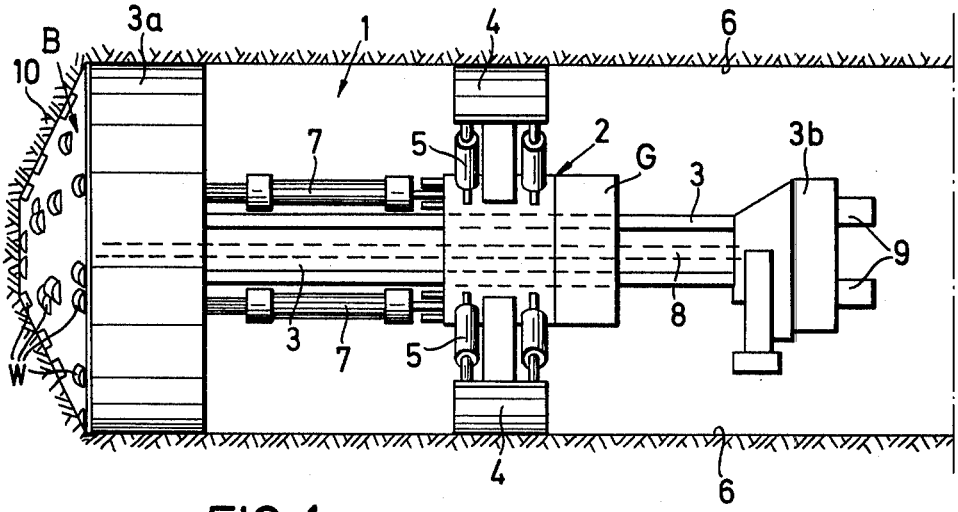
FIG. 1 shows a tunnelling apparatus for drilling boreholes.

The tunnelling machine 1 shown in FIG. 1 comprises two parts, movable relatively to each other, namely a support apparatus 2 and a machine body 3 guided therein. The support apparatus 2 may be clamped to the walls 6 of the excavation by means of support shields 4, which can be moved radially outwards by hydraulic cylinders 5. The machine body 2 carries at its head 3*a* a rotatably mounted drill head B, which is provided with tools W and is drivable by variable speed motors 9. The motors 9 may be located together with gearing means in the rear part 3*b* of the machine body, through a shaft 8 longitudinally passed through the machine body 3. The driving motors 9 may be hydraulic or electric. The means of energy supply and speed adjustment for these and other drives, as well as their arrangement and accommodation in tunnelling machines and other drilling apparatus are well known as such, and need not be further described.

For moving the machine body 3 forward relative to the support apparatus 2, clamped by means of the support shields 4 during a drilling operation use is made of hydraulic cylinders 7, which extend between the support apparatus 2 and the head 3a of the machine body 3, or the drill head bearing provided thereon, and which are acted upon by an adjustable pressure medium from a source (not shown) in such a way that the drill head B with its tool W can be applied to the rock face 10 with an adjustable forward force or at an adjustable forward speed. A definite depth of penetration per tool per revolution will result from a given number of revolutions at a constant forward speed.

Figure 2:
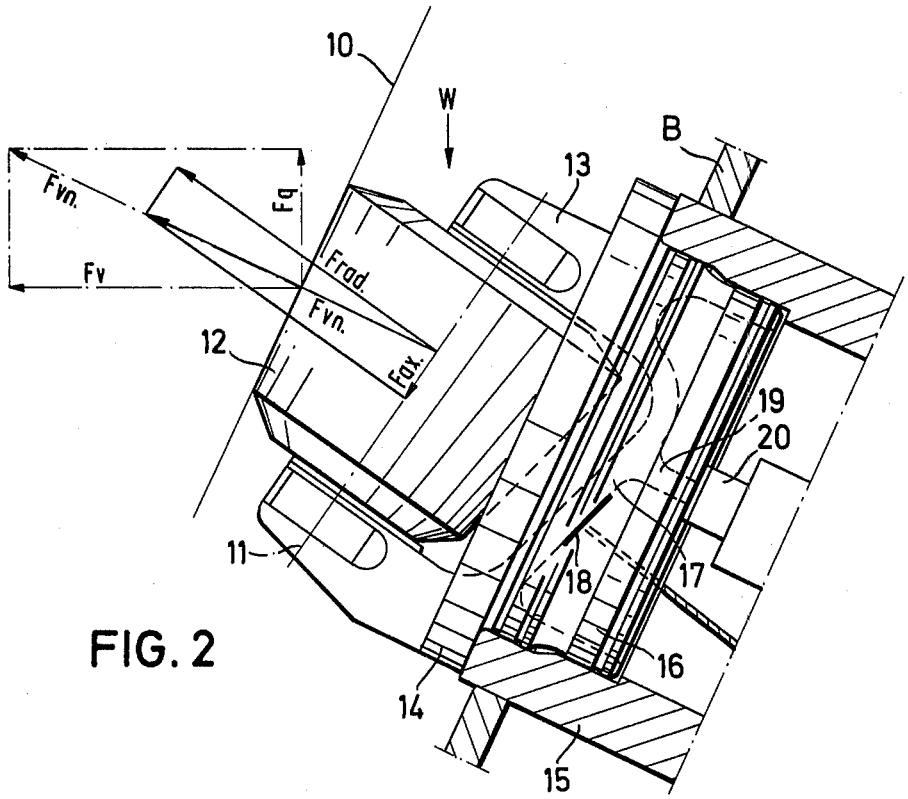
FIG. 2 shows a part of the drill head with tools, tool mountings and measuring means.
Figure 3:
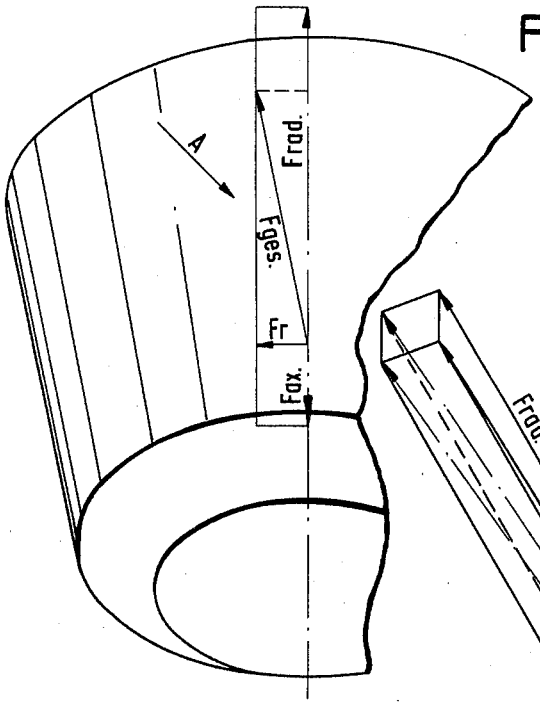
FIG. 3 shows a diagram of forces on a tool body.

As will be seen from FIG. 2, in the case of "wart" rollers i.e., roller bits having wear resistant inserts of compacts there will be in each tool W relatively to its axis of revolution 11 a static radial force $F_{rad.\ stat.}$ and an axial force $F_{ax}$. these yield a resultant force $F_{vn}$ directed normally to the side surface of the tool body 12, and this may be resolved into a force $F_v$ in the forward direction, i.e. in the longitudinal direction of the machine and tunnel, and a force $F_q$ transverse thereto.

Figure 4:
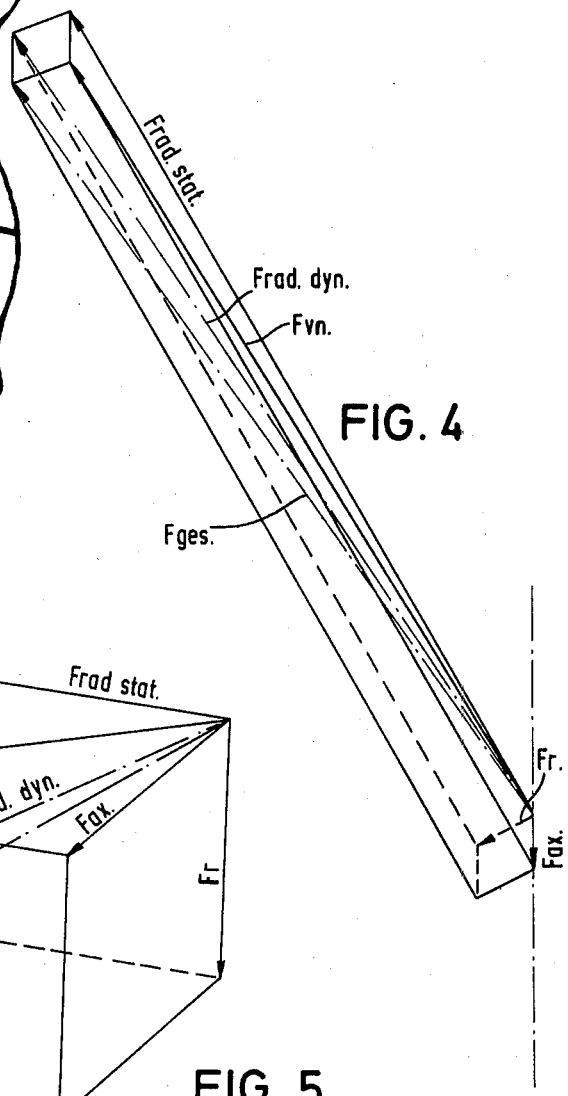
FIG. 4 is a perspective representation of the forces acting on a tool seen in the direction of the arrow A in FIG. 3.
Figure 5:
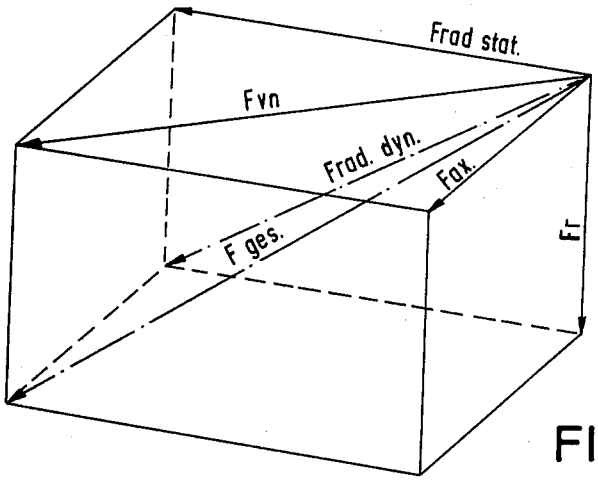
FIG. 5 is a representation of the forces, not drawn to scale, corresponding in principle to that of FIG. 4 in a different aspect.

A peripheral or rolling force $F_r$, directed tangentially to the side surface of the tool, arises from the rotation of the drill head B. In this way the force $F_{vn}$ (FIGS. 2,4 and 5) and force $F_r$ compose to a total resultant force $F_{ges}$. The resultant of the static radial force $F_{rad.\ stat.}$ and the force $F_r$ is called the dynamical radial force $F_{rad.dyn.}$ in FIGS. 4 and 5. As is shown in FIG. 4 for a case frequent in practice, the forces $F_{rad.stat.}$ or $F_{vn}$ or $F_{ges}$. are approximately of the same strength and in every case a multiple of the force $F_{ax}$ or $F_r$, so that one of them or even any sufficiently large component of one of these forces can be regarded as representative of the load on the tool.

Two examples of obtaining such a force respresentative of the load on the tool will be seen in FIG. 2. The tool body 12, e.g. a "wart" roller, which may also be a disc or toothed roller, is rotatable in the usual way upon a shaft which is indicated only by its median line 11 and the ends of which are received by a holder 13 in the form of a saddle. The holder 13 is screwed by its flange 14 over the end portion of a cylindrical bush 15, rigidly attached to the drill head B and extending thereinto, and fits with a correspondingly cylindrical and annular extension 16, which lies below the flange 14, into the sleeve 15. A grooved wall portion 17 of the holder 13 lying within the extension 16 experiences in the working of the tool W, a small but measurable deformation, which provides a measure of the load, and can be steadily measured by means of a measuring element 18 (see FIG. 2) in the form of a strip extensometer or strain gauge through a connection cable. An advantageous alternative for measuring the loading force consists in installing in the drill head B a fixed measurer 20 associated with the tool W, e.g. an inductive or piezo-electric meter, so that it can remain in position even if the tool is exchanged. For example, an extension 19, projecting from the wall 17 of the holder 13 and acting with its head surface on the meter, can serve for operating the meter 20.

The signals delivered by the measuring means for the individual tools of the drill head and corresponding to the loading force, designated by the letter P can be amplified and transmitted by a slip-ring device, or particularly a contactless transmitter, from the drill head B to the non-rotary part of the apparatus, e.g. to the machine body 3 of the machine in FIG. 1, and displayed and/or evaluated there. A power supply for the measuring means and the amplifier, as well as such further means as may be accommodated in the drill head, may come from a generator, making use of the rotation of the drill head, or from a battery or accumulator mounted in the drill head or through a transformer from the non-rotary part. The accumulator could be recharged while the machine was not working. This may advantageously be done in such a way that the drill head is immobilized in a predetermined angular position, and then a charging current from a source of current is supplied to the accumulaton through a special plug connection that can be automatically established between the drill head and the machine body.

Figure 6:
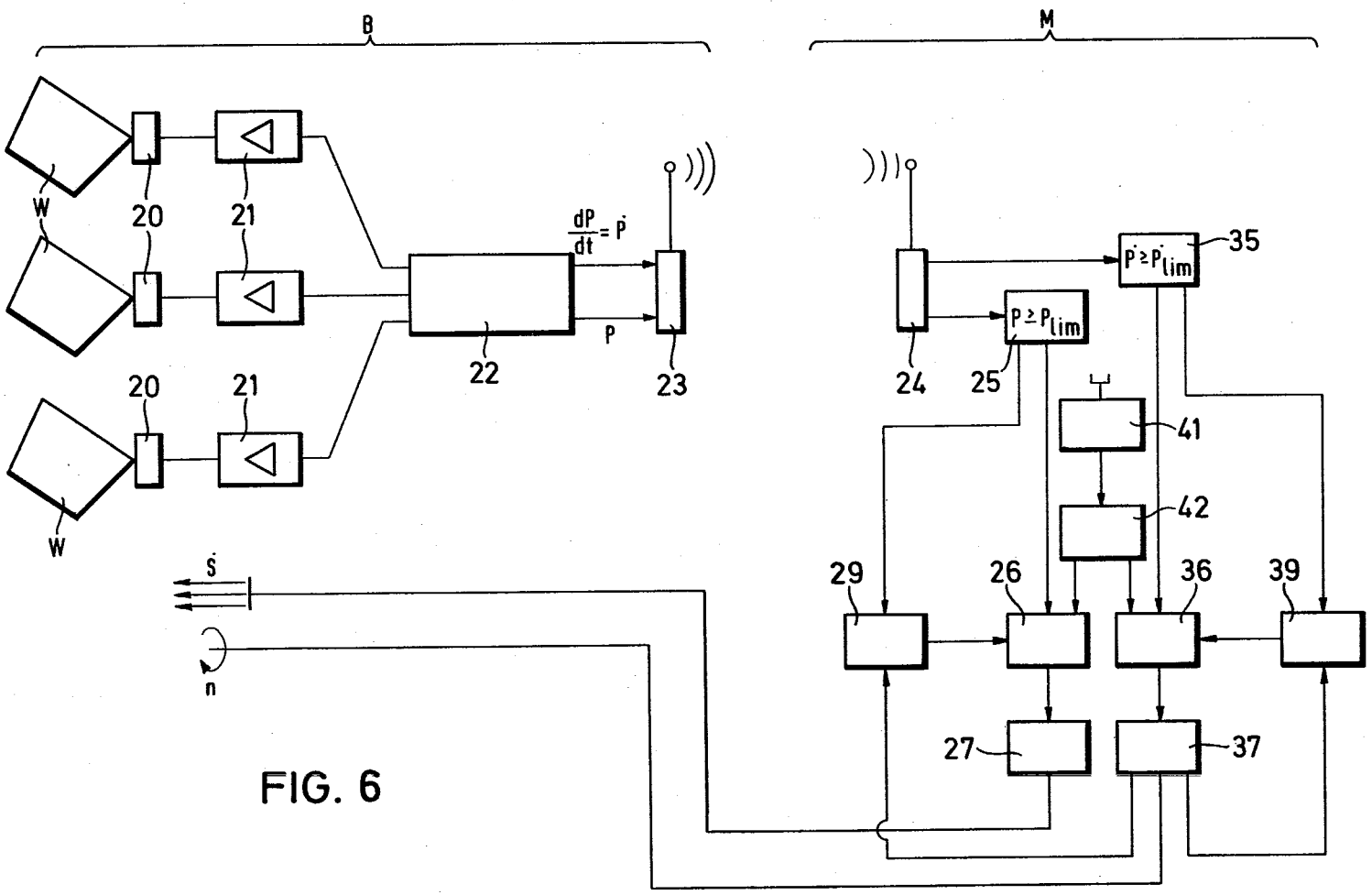
FIG. 6 shows a diagrammatic representation of a device according to the invention.
Figure 7A:
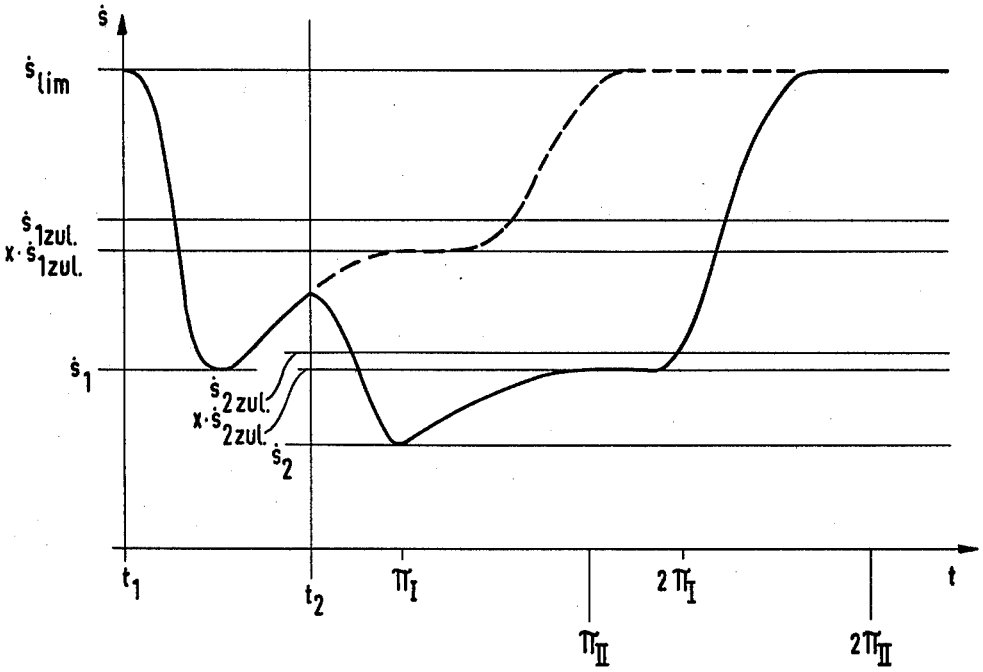
FIGS. 7*a* and 7*b* are diagrams illustrating the change of working parameters.
Figure 7B:
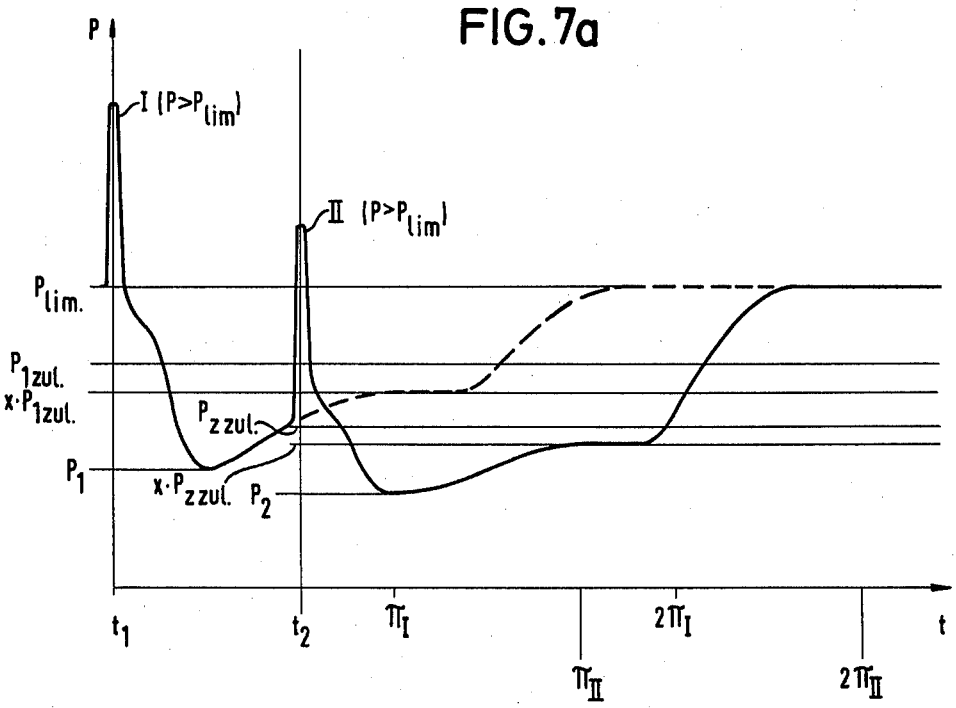

FIG. 6 shows a device whereby it is possible to carry out advantageoulsy and automatically drilling operations obviating undesirable overloading of the tools. Under the letter B in the drawing are shown the elements mounted on or in the rotating part which carries the tools W, and in the region below the letter M are shown the elements mounted on or in the non-rotating part (machine body, servicing stand, follower or the like) of the apparatus. In the tunnelling machine according to FIG. 1 the latter may be accommodated, for instance, in a housing G or else in the rear part 3a of the machine body.

The stress forces P on the tools W are currently measured by measuring means 20, such as are shown in FIG. 2. The signals delivered by the measuring means 20 are amplified in individual channels by amplifiers 21 and fed into the maximal-value reckoner 22. It will here be of advantage to have all the channels simultaneously and continuously scanned or registered. But it may also be advantageous to carry out the scanning by the multiplex method and to provide a memory from which the measurements in the available channels can be obtained for further processing in a predictable way.

The maximal-value reckoner 22 continuously determines the greatest stress $P_{max}$ on the tool under the heaviest load, and in the illustrated form of embodiment also calculates the variation of the stress in time as $dP/dt = \dot{\rho}$, which describes the rate of increase of the stress when shocks occur. Only the greatest stress value $P_{max}$ and the greatest slope value $\dot{\rho}_{max}$ chosen by the reckoner 22 are passed on in each case by an emitter 23 to a receiver 24, from which the stress signal for $P_{max}$ and the slope signal for $\dot{\rho}_{max}$ are fed into comparators 25 and 35.

The transmission of data from the emitter 23 to the receiver 24 may advantageously take place without wires. This may be done on the principle of frequency modulation (FM) or — and especially on that of amplitude modulation (AM), notably in the form of pulse-code method (PCM). The maximal-value reckoner 22 or a number associated therewith will then comprise a converter in which analogue data signals are converted to digital signals. Such signals can be transmitted in a way insensitive to perturbation even at low outputs.

The comparator 25 for stress values lets through all those stress data signals P that exceed a predetermined limiting value $P_{lim}$, ($P > P_{lim}$). The height of this limiting value $P_{lim}$ may advantageously be adjustable in the comparator 25. A safety factor x may also be considered here ($0 < x < 1$), so that the limiting value $P_{lim}$, set in the comparator, will be somewhat below the value that is considered admissible.

The same applies to the second comparator 35, i.e. this transmits all slope data signals $\dot{\rho}$ that exceed a predetermined value $\dot{P}_{lim}$, ($P > P_{lim}$). The limiting value $\dot{\rho}_{lim}$ may advantageously be adjusted as well, possibly taking a safety factor into consideration.

The stress data signals exceeding the predetermined value $P_{lim}$ which are passed on by the comparator 25 reach a regulator 26, which actuates a servo member 27 connected to it in sequence for setting or adjusting the forward speed $\dot{s}$. If the forward feed of the drilling apparatus relies e.g. on hydraulic cylinders (cf. cylinder 7 in FIG. 1) the servo member 27 may be a known instrument for varying the speed of a driving motor for the pump delivering the pressure medium to the cylinders. The same applies mutatis mutandis to other types of forward drive.

The regulator 26 causes the forward speed $\dot{S}$ to be reduced when it receives from the comparator 25 signals for stress values P exceeding the limiting value $P_{lim}$. Various possibilities that can be realized by the means available in the regulator construction (e.g. P behaviour, D behaviour, PID behaviour or the like) for suitable design of the regulator are open for the mode of operation of the regulator 26. The terms P behavior, D behavior, and PID behavior means certain known regulating characteristics (time characteristics) of regulating mechanisms or servo mechanisms, in which:

P: proportional amplifying system

I: integrating system

D: differentiating system

PID: system combining the said characteristics (particularly in parallel steps with adding up the three signals of said steps).

In a simple case it can be arranged that the regulator 26 whenever the limit is exceeded reduces $\dot{s}$ to a fixed, predetermined value $\dot{s}_1$, to which corresponds a load value P lying below a value $P_{zul}$ considered admissible in relation to the actual stress ($P < P_{zul}$), which can be determined experimentally or from the values known from experience. The regulator 26 can, however, act to trigger off a reduction of the forward speed $\dot{s}$ that is the greatest the more the stress value P communicated to it exceeds the limiting value $P_{lim}$ or the value $P_{zul}$ that is determined according to the immediately preceding stress and regarded as admissible in relation to it (this may be $x.P_{zul}$ if a safety factor $x$ is included).

Once the forward speed $\dot{s}$ has been reduced to, say, $\dot{s}_1$, the machine can continue working with this value, the loads on the tools remaining within the range which is considered admissible. If the disturbances that have led to the reduction of the forward speed cease, if e.g. the rocks in which the tools are working become softer after momentarily encountering hard patches, it is desirable to increase the forward feed speed, in order to adjust the performance of the machine and of the tools to the new conditions and to utilize them correspondingly. Such an increase in forward speed can be effected by the operator of the machine, and more particularly automatically in various ways by suitable design of the apparatus.

The apparatus may contain, in addition to or instead of the elements described above for varying the forward speed or forward driving force if the limiting stress value $P_{lim}$ is exceeded, suitable elements for varying the number of revolutions according to the crossing of the limiting value for steepness $\dot{P}_{lim}$, as shown in FIG. 6. A speed regulator 36, which can actuate a servo member 37 for altering the number of revolutions of the drill head, say by acting on the supply means for the driving motors (cf. motors 9 in FIG. 1), reduces the speed of rotation of the drill head if P oversteps the limit. Here the possibilities are fundamentally the same as has been described above in connection with varying the forward speed, so that it is superfluous to explain them again with reference to varying the speed of rotation.

In the form of embodiment of the apparatus shown in FIG. 6 the comparators 25 and 35 are connected to two computers 29 and 39, which further communicate with the means setting the number of revolutions 37 or another element operating in dependence on the number of revolutions of the drill head. By means of the computers 29 and 39 suitable values for the forward speed $\dot{s}$ and the number of revolutions $n$ can be determined by reference to the existing situation and passed on to the reckoners (computers) 26 and 36 for processing.

Examples of the operation of the apparatus according to FIG. 6 are particularly explained below with reference to FIGS. *7a* and *7b*. Here FIG. *7a* shows the forward speeds and FIG. *7b* the corresponding stresses plotted against time. It may be assumed that a bore-hole is to be drilled by means of a drilling machine (cf. FIG. 1) in limestone or a rock of similar properties. On the basis of the data known from experience a certain load value $P_{lim}$ can be admitted as a limit, which is set on the comparator 25 for the intended operation, and which corresponds to a limiting forward speed $\dot{s}_{lim}$. If there is no disturbance (e.g. in the form of shocks due to hard enclosures or the like) this forward speed can be maintained throughout the operation.

Now FIGS. *7a* and *7b* show a shock occurring at a moment $t_1$, such as may arise if a tool encounters a hard stone enclosed in soft rock. Thus the load P exceeds the limiting value $P_{lim}$ set on the comparator 25, so that the regulator 26 effects a reduction of the forward speed to a value $\dot{s}_1$, which corresponds to a load $P_1$ lying below a value $x \cdot P_{izul}$, where $P_{izul}$ denotes a load that is still considered admissible for the encountered disturbance of the tools, $x$ being a safety factor of e.g. 0.9. The forward motion reckoner 29 connected to the comparator 25 has received from it the value $P < P_{lim}$ arising from the disturbance, computed according to the desired programme the value $\dot{s}_1$ and passed this on to the forward motion regulator 26. The reckoning programme or the regulation may be such that the lowering of the forward speed is the greater the more the stress P exceeds the limiting value in the encountered disturbance. In FIG. *7a* the values of the forward speed corresponding to the values $P_{izul}$ or $x \cdot P_{izul}$, are denoted by $\dot{s}_{izul}$ and $x \cdot \dot{s}_{izul}$ respectively.

The forward speed having been reduced to $\dot{s}_1$, the regulator 26 will again trigger off an increase of forward speed, to begin with to an intermediate stage with the value $x \cdot \dot{s}_{izul}$ delivered by the computer 29, which corresponds to the load $x \cdot P_{izul}$. The forward speed is kept at this value for at least one period $2\pi/a$. For the presentation in FIGS. *7a* and *7b* it is assumed that it refers to a drill head with two tools angularly spaced 180° apart and running on the same circular track. Thus the second tool after a period $\pi I$ (whose duration is determined by the number of revolutions of the drill head) reckoned as from the moment $t_1$ will encounter the enclosure, if it still exists, first met by the first tool. This is why a new increase in forward speed by the regulator 26 has to wait for this period to elapse. The known number of tools running on one circular track in the given drill head is fed into the computer 29 before the start of the operation. Since this is also informed about the rotation of the drill head by the member setting the number of revolutions 37, it can determine the required waiting time of one period, or if required several periods $2\pi/a$ and correspondingly instruct the regulator 26. If the disturbance does not recur the regulator 26 will be able to restore the forward speed to its original value $s_{lim}$ (corresponding to $P_{lim}$), as is shown by the dashed part of the graph in FIGS. *7a* and *7b*.

FIGS. *7a* and *7b* illustrate as an example the further case where at a moment $t_2$, while the forward feed speed is still below $x \cdot \dot{s}_{izul}$, there is a second disturbance, imposing a correspinding load P. Despite the reduced forward speed, this is comparatively great, which may mean that it is caused by a still harder inclusion in otherwise soft rocks. The reckoner 29, which has received the corresponding datum from the comparator 25, can take it into consideration and cause the regulator 26 to reduce the forward speed to a value $\dot{s}_2$, which corresponds to a load $P_2$ lying below the stress $x \cdot P_{2zul}$ that is considered admissible for this second disturbance, the latter being also less than the stress $x \cdot P_{izul}$. The corresponding value of forward speed is denoted by $x \cdot \dot{s}_{2zul}$.

The moment $t_2$ also initiates a new period sequence $\pi_{II}$, which is correspondingly offset with regard to the period sequence $\pi_I$ belonging to the first disturbance, and is now alone decisive for the ensuing increase in forward speed. As will be seen from FIGS. *7a* and *7b*, the machine waits for the completion of one period $\pi_{II}$ at the intermediate stage $x \cdot \dot{s}_{2zul}$, and only then if the disturbance has ceased is the forward speed raised back to its original value $\dot{s}_{lim}$. If the disturbance continues at the time $\pi_{II}$ the control means will continue to hold the forward speed for a further period $\pi$ at the value $x \cdot s_{2zul}$ and so on, until the disturbance finally disappears, and then the forward speed can be returned to its original value.

Several stages may be provided for raising the forward speed $\dot{s}$ from a previous reduction. While it may be of advantage in the case of individual shocks to increase the forward speed step by step, it may also be advantageous with frequent shocks to raise the forward feed speed linearly or continuously, always taking into account the size of the load considered admissible for the given conditions. This can be achieved by a suitable algorithm for the control device.

It has been explained above how when a limiting stress value is exceeded the forward speed is altered, i.e. lowered and then again raised. Instead of the speed of forward feed, it is also possible to vary the forward driving force, e.g. in hydraulic drives by varying the pressure of the hydraulic medium if this appears to be called for in a particular emergency.

The considerations discussed above regarding the changing of the forward feed when faced with a disturbance apply mutatis mutandis also to the varying of the number of revolutions of the drill head by means of the computer 39 and the regulator 36 when the limiting values for steepness $\dot{P}$ are exceeded, $\dot{P} < \dot{P}_{lim}$. What has been said also remains true in the case where the forward driving force or forward speed are to be altered in response to the exceeding of a limiting value, or where the number of revolutions is to be varied according to the loading in excess of a limiting value.

It will be seen from FIG. 6 that the apparatus also comprises a measuring or supervision means 41 for the driving torque of the drill head B. If the drill head is driven by e.g. an hydraulic motor the supervision means may be a pressure sensor which responds to a predetermined maximal pressure, corresponding to a certain driving torque, and issues a signal. The latter is fed into a co-ordinating computer 42, which can actuate the forward drive regulator 26 and the means controlling the number of revolutions 36 so as to deliver a command for reducing the forward speed $\dot{s}$ and/or increasing the number of revolutions $n$ until the torque again drops below the maximal value. The co-ordinating computer can operate according to a predetermined programme and decide whether in a given situation the forward speed has to be reduced first to a minimal value of the number of revolutions raised to a maximal value before the other quantities are altered, or if both quantities are to be changed simultaneously to a certain extent.

We claim:

1. A method of drilling a borehole with a plurality of tools in simultaneous operation, the tools being mounted on a rotatable drill head adapted to be rotated by rotary-motion drive means and to be moved in the direction of the borehole by forward-feed drive means, the tools moving in circular tracks (paths) during rotation of the drill head and executing jointly the boring work, the parameters of the boring procedure being:a) the track speed of the tools (being proportional to rotational speed of the drill head), b) the forward driving force applied to the drill head and the tools thereon and c) the forward-feed speed of the drill head and the tools thereon, the method comprising the steps of: measuring at least at one of the working tools on the drill head a load characterizing value representative of the stress of said tool itself; comparing these measured load values with a predetermined limiting value; and altering at least one of said working parameters if this limiting value is exceeded.

2. A method according to claim 1, wherein continuously the highest value of the measured load values is determined (by a maximal value detecting means) and is compared with said predetermined limiting value, and wherein the therefrom resulting highest value, in excess of said predetermined limiting value, is taken as the decisive value for altering said working parameter (by influencing said drive means).

3. A method according to claim 1 comprising measuring the torque required for rotating the drill head with the tools thereon, wherein if a preset value of said torque is exceeded, the forward driving force is reduced by controlling said forward-feed drive means.

4. A method according to claim 1 comprising measuring the torque required for rotating the drill head with the tools thereon, wherein if a preset value of said torque is exceeded, the forward-feed speed is reduced by controlling said forward-feed drive means.

5. A method according to claim 1 comprising measuring the torque required for rotating the drill head with the tools thereon, wherein if a preset value of said torque is exceeded, the track speed of the tools is increased by controlling said rotary motion drive means.

6. A method according to claim 1, wherein as said load characterizing value representative of the stress of the tool a force-value is measured as said predetermined limiting value and the force-value that which is altered is set.

7. A method according to claim 6, wherein the forward-feed speed of the drill head with the tools thereon is reduced (by decreasing the acting speed of the forward-feed drive means) when the limiting value of the force-value is exceeded.

8. A method according to claim 7, wherein the track speed of the tools is maintained substantially constant by maintaining substantially constant the number of revolutions of the drill head when reducing the forward-feed speed.

9. A method according to claim 6, wherein the track speed of the tools is increased (by raising the rotational speed of the drill head by influencing said torary motion drive means) when the limiting value for the force-feed is exceeded.

10. A method according to claim 9, wherein the forward driving force is maintained substantially constant (by maintaining substantially constant the acting pressure of said forward-freed drive means) when the track speed of the tools is increased.

11. A method according to claim 6, including reducing the forward driving force acting on the drill head with the tools thereon by decreasing the effective pressure of said forward-feed speed of the drill head if the limiting value for the force-value is exceeded.

12. A method according to claim 11, wherein the track speed of the tools is maintained substantially constant by maintaining substantially constant the number of revolutions of the drill head when reducing the forward driving force.

13. A method according to claim 1, wherein the varying of the force with respect to time is measured and determined as said predetermined limiting value and a varying-of-force-with-respect-to-time value is set as said load-characterizing value representative of the stress of the tool.

14. A method according to claim 13, wherein the forward driving force acting on the drill head with the tools thereon is reduced (by decreasing the acting pressure of said forward-feed drive means) when the limiting value for the varying-of-force-with-respect-to-time-is-exceeded.

15. A method according to claim 14, wherein the track speed of the tools is maintained substantially constant by maintaining substantially constant the number of revolutions of the drill head when reducing the forward driving force.

16. A method according to claim 13, wherein the forward-feed speed of the drill head with the tools thereon is reduced (by decreasing the acting speed of the forward-feed drive means) when the limiting value for the varying-of-force-with-respect-to-time is exceeded.

17. A method according to claim 16, wherein the track speed of the tools is maintained substantially constant by maintaining substantially constant the number of revolutions of the drill head when reducing the forward-feed speed.

18. A method according to claim 13, wherein the track speed of the tools is decreased (by decreasing the rotational speed of the drill head by influencing said rotary drive means) when the limiting value for the varying-of-force-with-respect-to-time is exceeded.

19. A method according to claim 18, wherein the forward driving force is maintained substantially constant (by maintaining substantially constant the acting pressure of said forward-feed drive means) when decreasing the track speed of the tools.

20. A method according to claim 1, wherein at least one working parameter to be altered is set at a predetermined value (by influencing a control means for the said parameter), said value being below that corresponding to the admissible load on the tools when the limiting value is exceeded, and that thereupon the value of said working parameter is altered in an opposite sense.

21. A method according to claim 20, wherein said altering of said working parameter in the opposite sense is carried out continuously.

22. A method according to claim 21, wherein the value of the working parameter at the intermediate stage is predetermined.

23. A method according to claim 21, wherein the value of the working parameter at the intermediate stage is chosen according to the size of a resistance to the forward movement of the tools.

24. A method according to claim 20, wherein when altering of said working parameter in the opposite sense, at least one intermediate stage is interposed during which the said working parameter remains substantially constant.

25. A method according to claim 24, wherein starting from the intermediate stage, an ensuing change in the working parameter in said opposite sense is undertaken only when at least one period of $2\pi/a$ has elapsed, since the limiting value was first exceeded without this limit being again overstepped; "$2\pi$" denoting a complete circular run of a tool and "$a$" the number of tools running on one circular track.

26. A method according to claim 1, wherein the working parameter to be altered is set at a value which is representative of the extent by which said limited value is exceeded (by influencing a control means for the said parameter) when the limiting value is exceeded, said value being below that corresponding to the admissible load on the tools, and that thereupon the value of said working parameter is altered in the opposite sense.

27. A method according to claim 26, wherein said altering of said working parameter in the opposite sense is carried out continuously.

28. A method according to claim 27, wherein the value of the working parameter at the intermediate stage is predetermined.

29. A method according to claim 27, wherein the value of the working parameter at the intermediate stage is chosen according to the size of an encountered disturbance in the forward movement of the tools.

30. A method according to claim 26, wherein when altering of said working parameter in the opposite sense, at least one intermediate stage is interposed during which the said working parameter remains substantially constant.

31. A method according to claim 30, wherein starting from the intermediate stage, an ensuing change in the working parameter in said opposite sense is undertaken only when at least one period of $2\pi/a$ has elapsed, since the limiting value was first exceeded without this limit being again overstepped; "$2\pi$" denoting a complete circular run of a tool and "$a$" the number of tools running on one circular track.

32. A device for drilling a borehole comprising a drill head having mounted thereon a plurality of tools, rotary motion drive means and forward-feed drive means for rotating and feeding the drill head respectively, tool load measuring means located at and operatively associated with at least one of the tools on said drill head and including means to supply measured individual tool load value signals, computer means coupled to said tool load value signals to output signals representative of the stress acting individually on at least one of the tools on said drill head, and operational means adapted to receive said output signals and comprising comparator means for determining and passing on those of the output signals of the computer means supplied to it that exceed a preset limited value, regulator means coupled to said comparator means for receiving the signals exceeding said limiting value, and servo members for controlling said drivemeans for the drill head and being operatively associated to said regulator means.

33. A device according to claim 32, wherein said regulator means is operative for controlling the forward driving force to a predetermined value when loading forces on said tool exceed said preset limiting value are present, said predetermined value corresponding to a load value below said load limiting value.

34. A device according to claim 32, wherein said regulator means is operative for controlling the forward speed to a predetermined value when loading forces on said tool exceeding said preset limiting value are present, said predetermined value corresponding to a load value below said load limiting value.

35. A device according to claim 32, further including means for controlling the number of revolutions of the drill head in dependence on the occurrence of loading on the tool exceeding said limiting value, said number of revolutions being controlled to a value corresponding to a load value below said limiting value.

36. A device according to claim 32, wherein said preset limiting value is a limiting value representative of variations of loading on the tool with respect to time and said regulator means controls for forward driving force to a value corresponding to an actual load-variation-with-respect-to-time value lower than said preset limiting value when said preset limiting value is exceeded.

37. A device according to claim 32, wherein said preset limiting value is a limiting value representative of variations of loading on the tool with respect to time and said rectangular means controls the forward-feed speed to a value corresponding to an actual load-variation-with-respect-to-time value lower than said preset limiting value when said preset limiting value is exceeded.

38. A device according to claim 32, further including means for controlling the number of revolutions of the drill head to a number of revolutions lying below said preset limiting value representative of the variation of loading on the tool with respect to time.

39. A device according to claim 32, including means for supplying a value corresponding to the rotational speed of the drill head, wherein further said operational means comprise a computer means operatively connected to said comparator means and to said rotational speed value supplying means, said computer means being adapted to supply to said regulator means a governing value for the forward drive force.

40. A device according to claim 32, including means for supplying a value corresponding to the rotational speed of the drill head, wherein further said operational means comprise a computer means operatively connected to said comparator means and to said rotational speed value supplying means, said computer means being adapted to supply to said regulator means a governing value for the forward-feed speed.

41. A device according to claim 31, including means for supplying a value corresponding to the rotational speed of the drill head, wherein further said operational means comprise a computer means operatively connected to said comparator means and to said rotational speed value supplying means, said computer means being adapted to supply to said regulator means a governing value for the number of revolutions of the drill head.

42. A device according to claim 32, further including measuring means for measuring the drive torque of the drill head and control means actuable thereby, whereby, if a predetermined maximal value of the driving torque is exceeded, the forward driving force can be reduced and a coordinating computer is preconnected to said regulator means of said operational means.

43. A device according to claim 32, further including measuring means for measuring the drive torque of the crill head and control means actuable thereby, whereby if a predetermined maximal value of the driving torque is exceeded the forward-feed speed can be reduced and a coordinating computer is preconnected to said regulator means of said operational means.

44. A device according to claim 32, further including means for transmitting signals from said rotatable drill head to part of the device mounting the same by electromagnet waves.

45. A device according to claim 32, wherein said load measuring means are arranged on the tools.

46. A device according to claim 32, wherein said load measuring means are arranged on tool holders.

47. A device according to claim 32, wherein said load measuring means are accommodated in the drill head.

48. A device according to claim 32, wherein said computer means include a maximum-value reckoner for determining and delivering the highest of measured value signals being simultaneously supplied to it by said load measuring means.

49. A device according to claim 31, wherein said operational means is provided with at least one timing member for monitoring at least one period $2\pi/a$ in the operation of said regulator means, where "$2\pi$" denotes a complete revolution of a tool in its circular track and "$a$" the number of tools running on one circular track.

50. A device according to claim 49, wherein said timing member is included in a computer means being operatively associated to said comparator means and to means for supplying a value corresponding to the rotational speed of the drill head.

51. A device according to claim 32, further including measuring means for measuring the drive torque of the drill head and control means actuable thereby, whereby if a predetermined maximal value of the driving torque is exceeded the number of revolutions of the drill head can be increased.

52. A device according to claim 51, wherein a coordinating computer is preconnected to said regulator means of said operational means.

53. A device according to claim 32, wherein said computer means include means for obtaining and storing measured value signals supplied by said load measuring means in the multiplex-method.

54. A device according to claim 53, wherein said computer means include a maximum-value reckoner for determining and delivering the highest of said signals obtained and stored in said multiplex-method.

* * * * *